US006189558B1

(12) United States Patent
Traylor

(10) Patent No.: US 6,189,558 B1
(45) Date of Patent: Feb. 20, 2001

(54) UNIVERSAL PORT VACUUM BREAKER ADAPTED FOR MOUNTING WITHIN THE UPPER ENDS OF STANDPIPES OF DIFFERENT SIZES

(76) Inventor: Paul L. Traylor, 19171 LaLoma, Santa Ana, CA (US) 92705

( * ) Notice: Under 35 U.S.C. 154(b), the term of this patent shall be extended for 0 days.

(21) Appl. No.: 09/434,769

(22) Filed: Nov. 4, 1999

(51) Int. Cl.[7] ..... E03C 1/12
(52) U.S. Cl. ..... 137/216; 137/216.1
(58) Field of Search ..... 137/216, 216.1

(56) References Cited

U.S. PATENT DOCUMENTS 3,411,524 11/1968 Raine et al. .
4,163,457 * 8/1979 Rickel et al. ..... 137/216
4,722,556 * 2/1988 Todd ..... 285/12
5,176,165 1/1993 Traylor .
5,305,778 4/1994 Traylor .
5,592,964 1/1997 Traylor .

* cited by examiner

*Primary Examiner*—Gerald A. Michalsky
(74) *Attorney, Agent, or Firm*—Joseph F. McLellan

(57) ABSTRACT

A vacuum breaker having inlet port arrangements for accepting either a single input flow or multiple input flows, and adapted to vent multiple input flow substantially independently of one another, and further adapted for mounting within the open upper ends of waste standpipes of different diameters.

14 Claims, 2 Drawing Sheets

FIG. 5
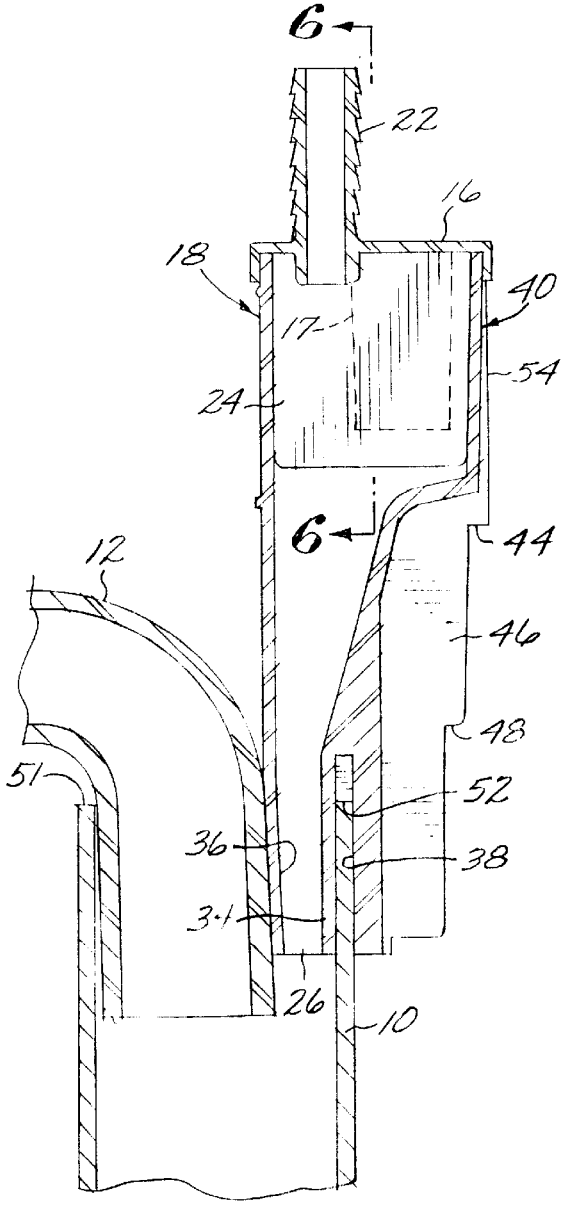
FIG. 6
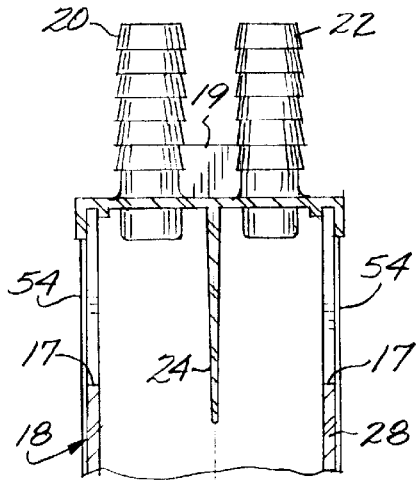
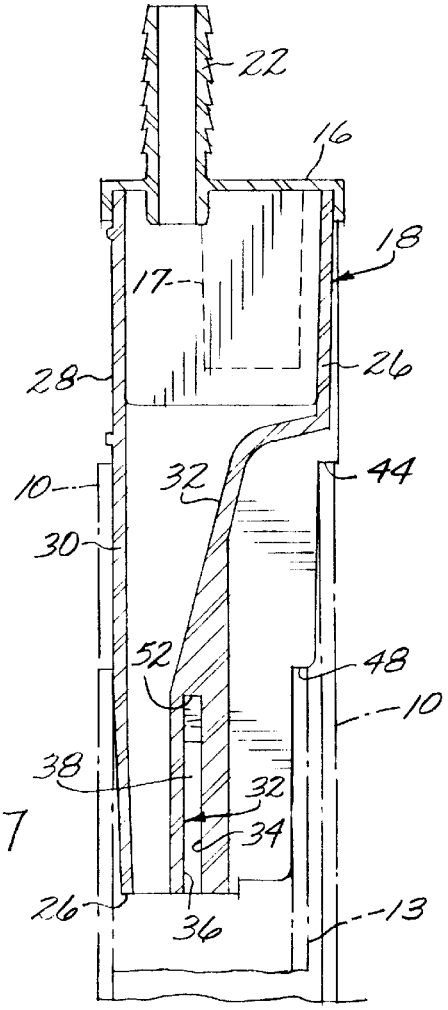
FIG. 7

UNIVERSAL PORT VACUUM BREAKER ADAPTED FOR MOUNTING WITHIN THE UPPER ENDS OF STANDPIPES OF DIFFERENT SIZES

BACKGROUND OF THE INVENTION

1. Field of the Invention

The present invention relates to a vacuum breaker having a universal inlet port, a one port embodiment for handling a single high rate fluid flow, and a two port embodiment for handling a plurality of low rate fluid flows, as in a dialysis unit application for venting to atmosphere both patient waste fluids and reverse osmosis (RO) waste water, the vacuum breaker further having a universal mounting arrangement for location of the vacuum breaker inside the upper ends of either relatively small or relatively large standard size waste standpipes.

2. Description of the Prior Art

Prior art vacuum breakers that discharge into a waste standpipe usually are mounted by forcing them onto the upper end of the standpipe, deforming the material of which the vacuum breaker is made to provide a clamping action. This makes them susceptible to tipping and inadvertent detachment. Furthermore, the clamping force must be overcome to remove them from the standpipe, which slows the process of removing one vacuum breaker and substituting another. This is a particular problem in an installation where a plurality of vacuum breakers are in use, such as in an installation comprising many dialysis units.

Dialysis units perform a well known function in various applications. In particular, such a unit filters the blood, essentially performing for the dialysis patient that which the kidneys do in a healthy individual. The kidney cleansing procedure generates both patient waste fluids and reverse osmosis (RO) waste fluid, the integral RO unit being present to facilitate proper operation of the dialysis unit.

In a dialysis unit the discharge lines from the patient's body fluids and the RO waste water both empty into the same waste standpipe. Where several dialysis units are combined in a single installation, the discharge lines empty into separate waste standpipes, with each unit being periodically removed upon completion of the cleansing procedure for replacement by another.

The discharge lines are commonly secured within each waste standpipe by means of screw clamps or banding. These must be individually tightened to prevent inadvertent separation. Tedious mounting procedures are time consuming. This poses a serious problem where only one nurse or medical assistant is available for servicing several dialysis units. The mounting or attachment means must also fit onto waste standpipes of at least the two most standard sizes, i.e. 1½ inches and 2 inches in diameter.

A need exits for a vacuum breaker that can be fitted quickly and easily onto standpipes and just as readily be detached when necessary.

Vacuum breakers are known for venting waste water flow from a reverse osmosis unit, but applicant is not aware of any vacuum breaker that operates like two separate vacuum breakers to simultaneously drain and vent RO waste water and patient fluids from a dialysis unit.

It is common to vent water flowing at a high rate from a washing machine, dishwasher or water softener, as disclosed in U.S. Pat. No. 3,411,524 for "Vacuum Breaker", invented by Robert E. Raine and applicant. However, nothing comparable appears to exist for venting two different fluid streams with a single vacuum breaker, and that acts like two separate vacuum breakers to achieve simplicity of operation, reduced cost and ease of installation. Somewhat analogous but far from similar devices are disclosed in my U.S. Pat. Nos. 5,592,964 and 5,176,165.

SUMMARY OF THE INVENTION

According to the invention, one embodiment of the present vacuum breaker or air gap device operates in a manner similar to that of the air gap device of U.S. Pat. No. 3,411,524, venting a single rapidly flowing fluid.

In a preferred embodiment, however, the air gap device includes twin input ports adapted to receive two different fluid streams, such as the patient waste and RO discharges from a dialysis unit.

The effluent from these air gap devices can be emptied into two different standard sizes of waste standpipes, such as 1½ and 2 inches in diameter.

For this purpose, the housing is provided with tapered ribs adapted to engage the curved inner surfaces of two sizes of standpipe to securely hold the device in position. The ribs include two sets of shoulders or stops to precisely locate the device vertically and in proper position in the respective standpipes. Furthermore, even when fully installed within the larger pipe size the upper stops are strategically located below the (C/L) location to allow for desirable standpipe venting.

The device includes internal stiffening sections to reinforce sections of the device against bending or deflection, also includes a partition to isolate and vent two different fluid flows in the region of the air gap openings, such that the single housing air gap device acts like a dual vacuum breaker.

Other features and advantages of the invention will become apparent from the following detailed description, taken in conjunction with the accompanying drawings which illustrate, by way of example, the features of the invention.

BRIEF DESCRIPTION OF THE DRAWINGS

FIG. 5 is a view taken along the line 5—5 of FIG. 1;

FIG. 6 is a view taken along the line 6—6 of FIG. 5; and

FIG. 7 is a view similar to FIG. 5, but illustrating the mounting of the air gap device to one or the other of two standard size waste pipes shown in phantom outline.

DESCRIPTION OF THE PREFERRED EMBODIMENTS

Figure 1:
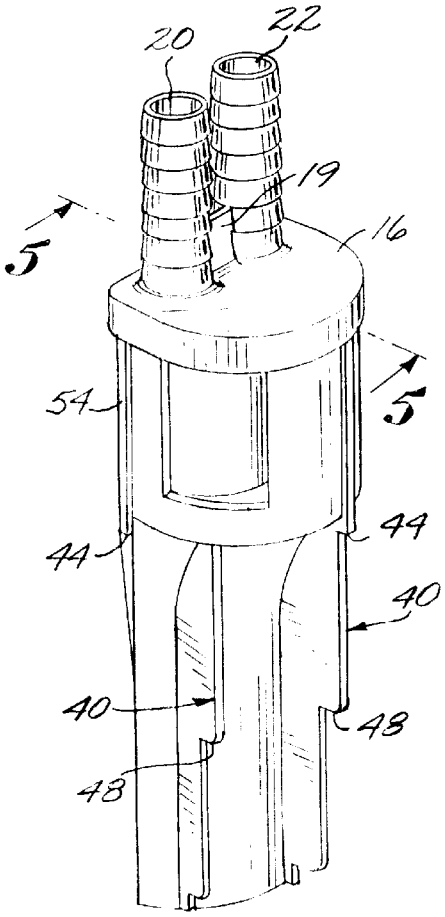
FIG. 1 is a perspective view of the vacuum breaker or air gap device according to the present invention.
Figure 2:
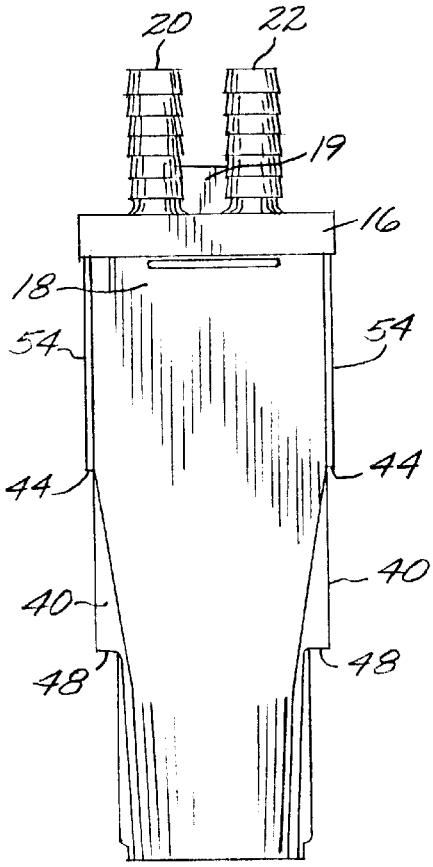
FIG. 2 is a rear elevational view of the air gap device of FIG. 1.

Referring now to the drawings, one embodiment of the present air gap device is shown in FIG. 5. It is illustrated as it would appear when slipped onto the upper end of a relatively large diameter waste standpipe 10. In this position a portion of the air gap is located outside the standpipe 10 so that space remains for insertion of a high fluid flow discharge line 12, such as the line from a water softener or the like (not shown). This adapts the present air gap device for service in certain household applications, such as that disclosed by me and my coinventor in U.S. Pat. No. 3,411,524.

Alternatively, if desired, the air gap device could be provided with a top cap having a single large inlet port so that the line 12 need not be located on the rim or lip of the standpipe, but can instead be attached to the single port. This will direct the flow into the air gap device where it can be vented as it travels through the device toward the outlet.

However, in the preferred embodiment of FIGS. 1–4 and 7, multiple inlet flows such as patient waste and RO flows from a dialysis unit (not shown) can be accepted through a twin inlet port top cap 16. This embodiment is also characterized by an air gap device having a bottom portion that can be slipped or dropped within the upper portion of the interior of the standpipe. The device can be slipped not only into the top of the large standpipe 10, as seen in phantom outline in FIG. 7, but also into the top of the smaller waste standpipe 13, as also seen in phantom outline.

Being able to simply allow the device to be dropped into proper vertical position under the force of gravity greatly facilitates easy insertion and removal of such devices. This is particularly desirable where, for example, several of the dialysis units are being used and their rapid servicing is important.

In the preferred embodiment the dual effluent flows of patient fluid and reverse osmosis (RO) waste water would be discharged from the dialysis unit and vented through opposed or confronting air gaps 17, and then emptied into one of the associated waste pipes 10 or 13, as the case may be. In a hospital employing multiple dialysis units, the waste from each unit is emptied into a separate standpipe.

The air gap device is molded or otherwise formed in one piece from suitable plastic material. It includes a housing 18, having the air gaps 17, and also the top cap 16, which is mounted upon the upper end of the housing 18.

The top cap 16 includes a pair of inlet ports 20 and 22 and preferably is slightly canted or tilted away from the axes of discharge of the ports 20 and 22 to minimize splattering of incoming fluids out of the air gaps 17.

Figure 3:
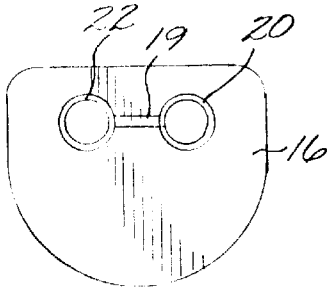
FIG. 3 is a top plan view of the air gap device.

As best seen in FIGS. 3 and 6, the pair of inlet ports 20 and 22 carried by the top cap 16 are conveniently arranged side by side to receive the patient fluid and RO discharges, respectively. The top cap 16 is preferably molded separately of the housing 18, and thereafter fixed in position on the housing 18 with adhesive, as seen in FIGS. 1, 2, and 5–7.

The cap 16 includes a stiffener web or wall 19, as best seen in FIG. 6, for added strength and resistance to bending of the barbed shafts of the inlet ports 20 and 22, which might otherwise occur from the weight of connecting hoses (not shown) which are generally several feet long.

The cap 16 also includes a slot (not shown) which closely receives a vertically oriented wall or divider 24 that is fixed in position with adhesive, as best seen in FIGS. 6 and 7. The divider 24 further rigidities the cap 16, but its main purpose is to isolate the patient fluid and RO discharge flows from each other in the vicinity of the air gaps 17.

The divider 24 is located between the air gaps 17 and preferably extends close to the front and rear walls of the housing 18. It also extends downwardly approximately to the critical level (C/L) of the air gap device. The C/L level is located just below the lower edges of the air gaps 17. If a downstream blockage occurs, or if a vacuum occurs at either of the inlet ports 20 or 22, both fluid flows entering the air gap device will be vented to atmosphere through the pair of air gaps 17, respectively, just as would occur if two vacuum breakers had been used.

An upper section 28 of the housing 18 defines the air gaps 17, and a lower section 30 includes an integral, vertically elongated conduit 32. The conduit 32 forms a downward continuation of the upper section 28 for draining fluids from the upper section and discharging them out of the lower end of the conduit 32.

Figure 4:
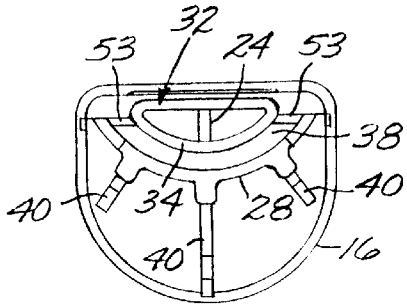
FIG. 4 is bottom plan view of the air gap device.

The downwardly projecting conduit 32, as best seen in FIG. 4, has a curvilinear inner wall 34. In the embodiment of FIG. 5, wherein the air gap device clamps onto a wastepipe, the inner wall 34 is adapted to engage the curved inner surface of the upper extremity of the smaller standard size waste standpipe 13, i.e. the one having the one and one-half inch diameter. The lower section 30 includes a curvilinear outer wall 36 opposite the wall 34. The wall 36 is adapted to engage the curved outer surface of the standpipe 13 whereby the standpipe may be snugly received in a pipe recess 38 formed between the inner and outer walls 34 and 36. The lower housing section 30 and the conduit 32 are joined at the top of the pipe recess 38 by a pair of webs or stops 53. The stops 53 are adapted to engage the top of the standpipe 10 to rigidify the structure and properly locate the air gap device relative to the standpipe 10. The rigidity provided by the webs 53 prevent unwanted widening or narrowing of the pipe recess 38.

In preferred embodiments, the air gap device fits within the upper end of the associated standpipe. For this purpose the lower housing section 30 includes five vertically elongated, radially outwardly directed, and circumferentially spaced apart ribs 40. Guide or upper portions 54 are located above the middle rib 40 and above the two outer ribs 40, respectively, and extend upwardly to the top of the housing 18. The lower ends of these upper portions 54 define shoulders or stops 44 which are dimensioned to engage the upper rim of the larger standpipe 10 when, as best seen in FIG. 7, the air gap device is dropped or otherwise placed within the upper end of the standpipe 10. This arrangement supports the air gap device on the stops 44 in stable vertical position within the upper end of the standpipe 10. There is no tendency of the air gap device to tip or tilt and thereby misdirect the stream of fluids coming out of the lower end of the conduit 32. If desired, the ribs 40 can be tapered or made larger at their upper extremities in order to fit snugly in the top of the standpipe 10.

The lower ends of all five ribs 40 are dimensioned to form shoulders or stops 48 which are adapted to rest upon the upper end of the smaller standpipe 13 when the smaller standpipe 13 is used. This arrangement allows dropping or locating of the air gap device within the upper end of the standpipe 13 for support of the air gap device by resting of the stops 48 on the top of the standpipe 13. If desired, the lower portions of the ribs 40 can be tapered to snugly fit within the standpipe 13.

Below the stops 48 all five ribs 40 are of reduced dimension so that as nearly as is possible they engage or are in close proximity with the curved inner surface of the standpipe 13.

Any suitable means may be used to attach drain lines to the inlet ports 20 and 22, according to the size of the drain lines and whether they are flexible or rigid. In addition, rather than using the illustrated combination of the externally barbed ports 20 and 22 with flexible plastic tubing (not shown), plastic pipe may be used in a slip fit arrangement with or without adhesive. Also, complemental components may be used that are joined in a compression fit, or the so-called John Guest push-in type of fitting can be used.

However, in the low flow applications contemplated by the present invention, a leak-tight connection is easily achieved by pushing flexible tubing over the barbed inlet ports 20 and 22.

As described above, the air gap device is versatile in that it can be mounted upon either of the two most widely used standard sizes of standpipe, whether the standpipe is made of plastic or of metal, and whether the standpipe is threaded or unthreaded. The structure of the air gap device is relatively strong and rigid, establishes positive seating and support of the device, and ensures that the device will not be tilted from its normal vertical position during use.

There are other features of this particular housing design which are important. The particular design and location of the rails 54 is such that the rails extend clear to the top of upper housing 18, adding structural rigidity to the otherwise more flexible upper housing portion.

In the embodiment of FIG. 5, stops 53, as best seen in FIG. 4 are located at each end of the mounting slot 38. The stops 53 help to maintain a uniform slot width throughout the length of the slot, and they provide solid and positive stops for the unit when the unit is inserted over either size of standpipe. Thus, the unit cannot easily be tilted away from its desired vertical position.

While several forms of the invention have been illustrated and described, it will be apparent that various modifications can be made without departing from the spirit and scope of the invention.

What is claimed is:

1. A vacuum breaker comprising:

housing means which includes an upper section having air gap opening means, and which further includes a lower section adapted for mounting in the open upper end of a standpipe, the housing means having a plurality of vertically oriented, radially outwardly directed and circumferentially spaced apart ribs, certain of the ribs having radially inwardly offset portions defining upper stops adapted to rest upon the top of a larger diameter standpipe, and lower stops adapted to rest upon the top of a smaller diameter standpipe.

2. A vacuum breaker according to claim 1 wherein the air gap opening means comprises a pair of air gap openings on opposite sides of the upper section of the housing means.

3. A vacuum breaker according to claim 2 wherein the housing means includes divider means defining a pair of interior spaces in fluid communication with the pair of air gap openings, respectively.

4. A vacuum breaker according to claim 3 in which the housing means includes opposed front and rear walls and a critical level (C/L), and the divider means extends between the front and rear walls and downwardly to a position below the air gap openings.

5. A vacuum breaker according to claim 3 wherein the housing means includes front and rear walls and a discharge outlet, the divider means extending downwardly to form an adjacent pair of separate flow channels extending from the pair of interior spaces, respectively, to the discharge outlet.

6. A vacuum breaker according to claim 2 wherein the housing means includes a pair of inlet ports for receiving two waste flows, and further includes divider means disposed between the air gap openings and defining a pair of interior spaces in fluid communication, respectively, with the pair of inlet ports and with the pair of air gap openings.

7. A vacuum breaker according to claim 2 wherein the housing means includes a top cap for the upper section of the housing means, the top cap having two inlet ports for receiving two waste flows, and the upper section of the housing means further having divider means disposed between the pair of air gap openings to define a pair of interior spaces adapted to receive the two waste flows, each interior space being vented through a separate one of the air gap openings.

8. A vacuum breaker according to claim 7 wherein the housing means includes a stiffener extending between the pair of inlet ports to rigidify the inlet ports against deflection.

9. A vacuum breaker according to claim 7 wherein the top cap is formed separately of the upper section of the housing means to enable selective replacement of the top cap with a modified top cap.

10. A vacuum breaker according to claim 7 wherein the two waste flows comprise patient waste fluids and reverse osmosis waste fluid discharged from a medical dialysis unit.

11. A vacuum breaker according to claim 1 wherein the lower section of the housing means includes a pipe recess having opposed walls adapted for engagement upon the inner and outer surfaces, respectively, of the open upper end of the standpipe.

12. A vacuum breaker according to claim 11 and including a pair of webs extending between the opposed walls of the pipe recess at the upper extremity of the pipe recess whereby upon receipt within the pipe recess of a wall of a standpipe, the webs support opposite sides of the housing means and maintain it in a vertical position.

13. A vacuum breaker according to claim 1 wherein the housing means includes a plurality of vertically elongated, radially outwardly directed and circumferentially spaced apart ribs having upper portions and lower portions, the lower ends of certain ones of the upper portions being reduced in radial dimension to form upper stops adapted to rest upon the upper end of a larger standpipe, and certain ones of the ribs being reduced in radial dimension below the upper stops to form lower stops adapted to rest upon the upper end of a smaller standpipe.

14. A vacuum breaker according to claim 13 wherein the upper portions and lower portions are tapered outwardly in an upward direction to fit snugly within the associated standpipe.

* * * * *